US009726385B2

(12) United States Patent
Yun et al.

(10) Patent No.: US 9,726,385 B2
(45) Date of Patent: Aug. 8, 2017

(54) INDOOR UNIT OF AIR CONDITIONER AND METHOD OF CONTROLLING THE SAME

(71) Applicant: SAMSUNG ELECTRONICS CO., LTD., Suwon (KR)

(72) Inventors: Yeon Seob Yun, Suwon (KR); Jung Ho Kim, Suwon (KR); Jin Baek Kim, Suwon (KR); Hae Gyun Shin, Osan (KR); Jin Gyun Kim, Seongnam (KR); Woo Seog Song, Yongin (KR); Moon Sun Shin, Suwon (KR); Jae Youn Cho, Suwon (KR); Chang Woo Jung, Suwon (KR); Hyoung Seo Choi, Hwaseong (KR); Dong Gi Han, Seoul (KR); Jun Hwang, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 875 days.

(21) Appl. No.: 14/045,288

(22) Filed: Oct. 3, 2013

(65) Prior Publication Data

US 2014/0096941 A1 Apr. 10, 2014

(30) Foreign Application Priority Data

Oct. 8, 2012 (KR) ..... 10-2012-0111499

(51) Int. Cl.
*F24F 1/00* (2011.01)
*F24F 13/24* (2006.01)

(52) U.S. Cl.
CPC ..... *F24F 1/0059* (2013.01); *F24F 1/0007* (2013.01); *F24F 1/0011* (2013.01); *F24F 13/24* (2013.01); *F24F 2001/004* (2013.01)

(58) Field of Classification Search
CPC ..... F24H 3/00; F24H 3/02; F24F 1/00; F24F 1/0059

(Continued)

(56) References Cited

U.S. PATENT DOCUMENTS 745,313 A * 12/1903 Bate ..... E06B 1/006 126/315
2,037,663 A * 4/1936 Lalor ..... F16K 3/03 137/556

(Continued)

FOREIGN PATENT DOCUMENTS

| | | |
|---|---|---|
| CN | 2699177 | 5/2005 |
| CN | 1737449 | 2/2006 |
| JP | 4-20740 | 1/1992 |

OTHER PUBLICATIONS

Chinese Patent Office Action issued in Chinese Patent Application No. 201310464781.5 dated Apr. 28, 2017 (23 Total pages).

*Primary Examiner* — Len Tran
*Assistant Examiner* — Gustavo Hincapie Serna
(74) *Attorney, Agent, or Firm* — Staas & Halsey LLP

(57) ABSTRACT

An indoor unit of an air conditioner has an improved discharge structure of air. The indoor unit of an air conditioner includes a panel which defines an external appearance thereof and has an opening, a mixed flow fan which is located within the panel, a heat exchanger unit which is located rearward of the mixed flow fan, an inlet port which is located rearward of the heat exchanger unit so that air is suctioned from rearward of the heat exchanger unit to be introduced into the mixed flow fan, an outlet port which is exposed forward of the panel through the opening so that the air passing though the mixed flow fan is discharged through a front portion of the panel, and a plurality of circular louvers to open and close the outlet port by moving outwards from a center of the outlet port.

16 Claims, 15 Drawing Sheets

(58) Field of Classification Search
USPC .... 165/121, 122, 124, 96, 99; 454/221, 222, 454/224, 226, 254, 264, 265, 308, 309, 454/310, 317, 237–253
See application file for complete search history.

(56) References Cited

U.S. PATENT DOCUMENTS 2,097,078 A * 10/1937 Peabody ..... F23C 7/006 137/601.07
2,443,071 A * 6/1948 Honerkamp ..... F16K 3/34 137/625.3
2,672,087 A * 3/1954 Marr ..... F24F 13/06 454/308
2,839,267 A * 6/1958 Sieradzki ..... F16K 3/03 251/212
3,836,234 A * 9/1974 Farnsworth ..... G03B 9/08 250/229
4,094,492 A * 6/1978 Beeman ..... F16K 3/03 138/45
4,232,595 A * 11/1980 Cox ..... F23L 17/02 110/184
5,105,732 A * 4/1992 Sheu ..... F04D 25/14 454/350
5,148,683 A * 9/1992 Muller ..... F24F 1/0007 454/299
5,910,045 A * 6/1999 Aoki ..... F04D 17/02 454/186
6,050,892 A * 4/2000 Sodec ..... F24F 13/06 454/289
6,290,596 B1 * 9/2001 Birdsong ..... F24F 13/065 454/289
7,182,047 B1 * 2/2007 Schwartz ..... F01P 5/06 123/41.04
2005/0274135 A1 12/2005 Kim et al.
2006/0112773 A1 * 6/2006 Hedtke ..... G05D 7/0635 73/861.61
2008/0188174 A1 * 8/2008 Aminpour ..... F03D 1/04 454/309
2011/0159796 A1 * 6/2011 Carpenter ..... F24F 3/16 454/258
2011/0240255 A1 * 10/2011 Sakashita ..... F24F 1/0007 165/53

* cited by examiner

INDOOR UNIT OF AIR CONDITIONER AND METHOD OF CONTROLLING THE SAME

CROSS-REFERENCE TO RELATED APPLICATIONS

This application claims the priority benefit of Korean Patent Application No. 10-2012-0111499, filed on Oct. 8, 2012 in the Korean Intellectual Property Office, the disclosure of which is incorporated herein by reference.

BACKGROUND

1. Field

The following description relates to an indoor unit of an air conditioner having an improved structure of air discharge, and a method of controlling the same.

2. Description of the Related Art

In general, an air conditioner is a device which regulates temperature, humidity, flow, distribution, and the like of air and simultaneously eliminates dust and the like contained in air, to be suitable for human activity using a refrigeration cycle. A compressor, a condenser, an evaporator, a blowing fan, and the like are provided as main components of the refrigeration cycle.

The air conditioner is classified into a separate type air conditioner in which an indoor unit and an outdoor unit are separated and installed, and an integral type air conditioner in which the indoor unit and the outdoor unit are installed together.

The indoor unit of the separate type air conditioner includes a heat exchanger which exchanges heat with air introduced into a panel, and a blowing fan which introduces air of a room into the panel and blows the introduced air into the room again.

In general, the indoor unit of the separate type air conditioner is provided, at a lower portion thereof, with the blowing fan, and is provided, at an upper portion thereof, with the heat exchanger and an air outlet port to discharge air. Air which is introduced and blown by the blowing fan is moved to the upper portion of the indoor unit, and the air moved to the upper portion is discharged into the room via the heat exchanger and the air discharge port.

However, in the indoor unit of the air conditioner having such a structure, since the blowing fan and the heat exchanger are respectively arranged at the upper and lower portions of the indoor unit, the indoor unit has inefficient space utilization.

In addition, since the air passing through the blowing fan moves to the upper portion of the indoor unit and is then discharged into the indoor unit again, a passage from the lower portion to the upper portion of the indoor unit becomes long and the blowing fan has a large load to blow the introduced air. Thus, the indoor unit has inefficient utilization of energy and a limit to increase the volume and speed of air. In this case, when the heat exchanger and the blowing fan are arranged to be close to each other in order to achieve a compact and slim air conditioner, the blowing fan has deteriorated performance and increased noise due to an increase in air resistance of the heat exchanger.

Furthermore, in the indoor unit of the air conditioner, the air outlet or inlet port is generally opened and closed by moving horizontal or vertical blades, thereby regulating a discharge amount of air. However, such a structure has a problem in that the separate blades are controlled by a separate power source to thus have the increased number of components and a complicated structure. Moreover, since the outlet or inlet port is formed in a quadrangular shape when using the horizontal or vertical blades, products having a unified design are produced.

SUMMARY

Therefore, it is an aspect of the present disclosure to provide an indoor unit of an air conditioner having an improved structure of air introduction, air discharge, and an air passage so as to be able to enhance operation efficiency, reduce noise, and achieve a compact size, and a method of controlling the same.

It is another aspect of the present disclosure to provide an indoor unit of an air conditioner having an improved structure of an outlet port so as to be able to easily regulate the volume and direction of air by adjustment of opening and closing of the outlet port of the indoor unit, and a method of controlling the same.

Additional aspects of the disclosure will be set forth in part in the description which follows and, in part, will be apparent from the description, or may be learned by practice of the disclosure.

In accordance with one aspect of the present disclosure, an indoor unit of an air conditioner includes a panel which defines an external appearance thereof and has an opening, a mixed flow fan which is located within the panel, a heat exchanger unit which is located rearward of the mixed flow fan, an inlet port which is located rearward of the heat exchanger unit so that air is suctioned from rearward of the heat exchanger unit to be introduced into the mixed flow fan, an outlet port which is exposed forward of the panel through the opening so that the air passing though the mixed flow fan is discharged through a front portion of the panel, and a plurality of circular louvers to open and close the outlet port by moving outwards from a center of the outlet port.

The plurality of circular louvers may be coupled to a drive disc to move the circular louvers, and the drive disc may be coupled to a louver drive motor so as to be driven.

The drive disc may include a fixing disc to which the circular louvers are coupled, and a rotatable disc which is coupled between the fixing disc and the circular louvers and rotates to move the circular louvers coupled to the fixing disc.

The fixing disc may be provided with a fixing disc rail which is a moving route of each of the circular louvers, and the rotatable disc may be provided with a rotatable disc rail to move the circular louver along the fixing disc rail.

The indoor unit of an air conditioner may further include a coupling member to couple each of the circular louvers to the fixing disc, and the coupling member may be coupled, at one side thereof, to the fixing disc while being coupled, at the other side thereof, to the circular louver.

The rotatable disc rail may include a first rotatable disc rail and a second rotatable disc rail which have different shapes to individually open and close the left and right portions of the outlet port.

The indoor unit of an air conditioner may further include a louver drive motor housing to accommodate the louver drive motor.

The indoor unit of an air conditioner may further include a diffuser which is arranged forward of the mixed flow fan, the diffuser may include a circular disc plate and a grill which is coupled to an outer peripheral surface of the disc plate, and the outlet port may be formed between the disc plate and the grill.

The circular louvers may be located between the disc plate and the grill to open and close the outlet port.

The indoor unit of an air conditioner may further include a controller which independently controls each of the plurality of circular louvers according to a selected operation mode and generates a control command to open and close all or a portion of the outlet port.

In accordance with another aspect of the present disclosure, an indoor unit of an air conditioner includes a panel which includes a front panel having an opening, a rear panel coupled to the rear of the front panel, an inlet port which is formed at a position corresponding to an outlet port in the rear panel, a heat exchanger which is arranged forward of the inlet port, a mixed flow fan unit which is arranged forward of the heat exchanger and has the outlet port exposed forward of the front panel through the opening, and an opening and closing unit to open and close at least a portion of the outlet port, wherein the opening and closing unit includes a plurality of circular louvers to close the outlet port by moving outwards from a central portion of the outlet port, and to open the outlet port by moving toward the central portion from outward of the outlet port, a drive disc to move the plurality of circular louvers, and a louver drive motor which drives the drive disc to drive the circular louvers.

The drive disc may include a fixing disc to which the circular louvers are coupled, and a rotatable disc which is coupled between the fixing disc and the circular louvers and rotates such that the circular louvers coupled to the fixing disc are linearly moved outwards from the central portion of the outlet port.

The fixing disc may be provided with a fixing disc rail which is a moving route of each of the circular louvers, and the rotatable disc may be provided with a rotatable disc rail to move the circular louver along the fixing disc rail.

The circular louvers may include a first circular louver and a second circular louver which open and close the left portion of the outlet port and a third circular louver and a fourth circular louver which open and close the right portion of the outlet port, the rotatable disc rail may include first rotatable disc rails which are respectively coupled with the first and second circular louvers, and second rotatable disc rails which are respectively coupled with the third and fourth circular louvers, and the first and second rotatable disc rails may have different shapes.

The indoor unit of an air conditioner may further include a controller which independently controls each of the plurality of circular louvers according to a selected operation mode and generates a control command to open and close all or a portion of the outlet port.

In accordance with a further aspect of the present disclosure, a method of controlling an indoor unit of an air conditioner includes a panel which defines an external appearance thereof and has an opening, a mixed flow fan which is located within the panel, a heat exchanger unit which is located rearward of the mixed flow fan, an inlet port which is located rearward of the heat exchanger unit so that air is suctioned from rearward of the heat exchanger unit to be introduced into the mixed flow fan, an outlet port which is exposed forward of the panel through the opening so that the air passing though the mixed flow fan is discharged through a front portion of the panel, and a plurality of circular louvers to open and close the outlet port by moving outwards from a center of the outlet port, the method including selecting and receiving an operation mode, generating a control command to perform the selected operation mode, and independently controlling each of the plurality of circular louvers according to the control command to open and close all or a portion of the outlet port.

The independently controlling of the plurality of circular louvers may include independently opening and closing each of the plurality of circular louvers.

The independently controlling of the plurality of circular louvers may include variably controlling an opening degree of each of the plurality of circular louvers.

The independently controlling of the plurality of circular louvers may be to allow each of the plurality of circular louvers to be swung within a predetermined opening range.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
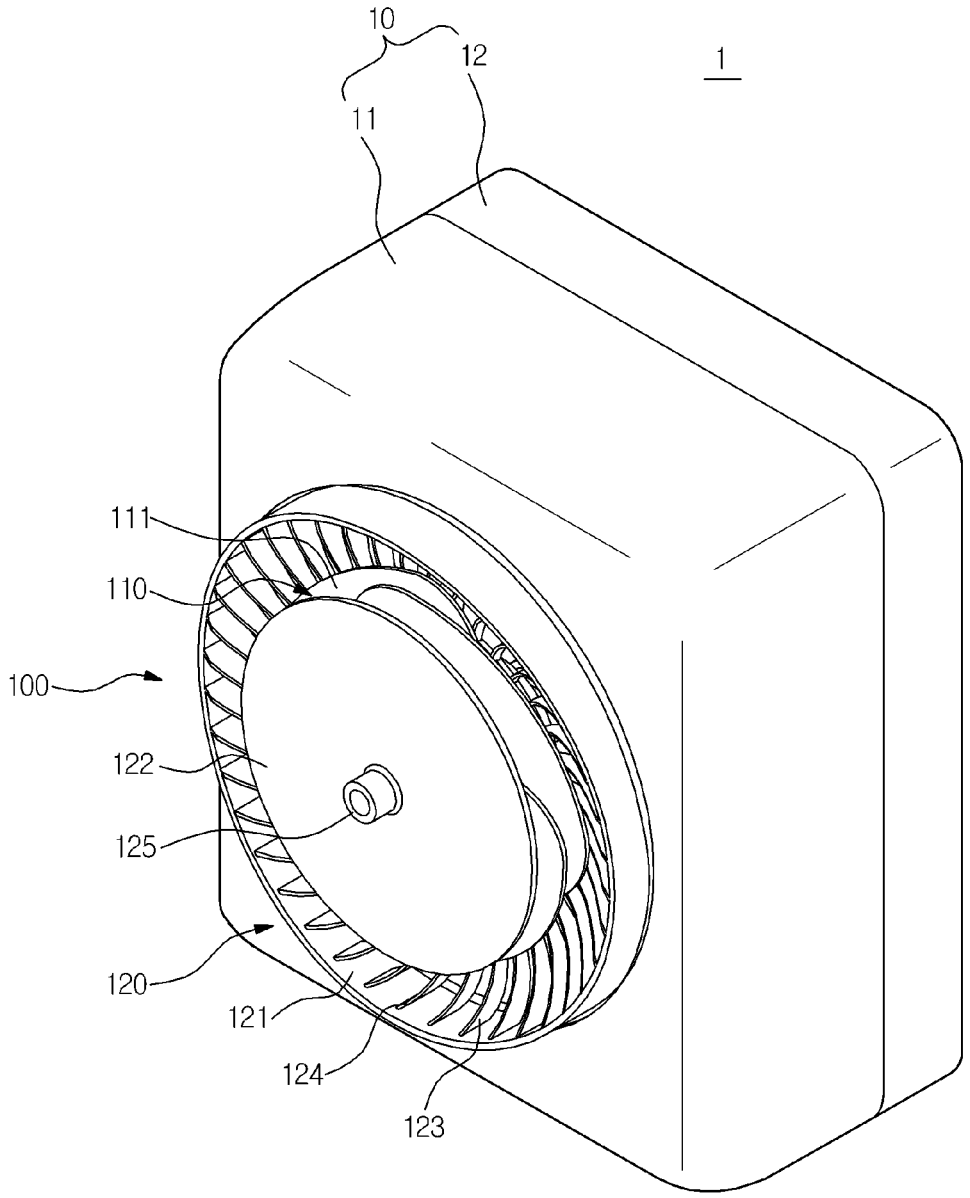
FIG. 1 is a view illustrating an indoor unit of an air conditioner according to an embodiment of the present disclosure.

Reference will now be made in detail to embodiments of the present disclosure, examples of which are illustrated in the accompanying drawings, wherein like reference numerals refer to like components throughout.

Figure 2:
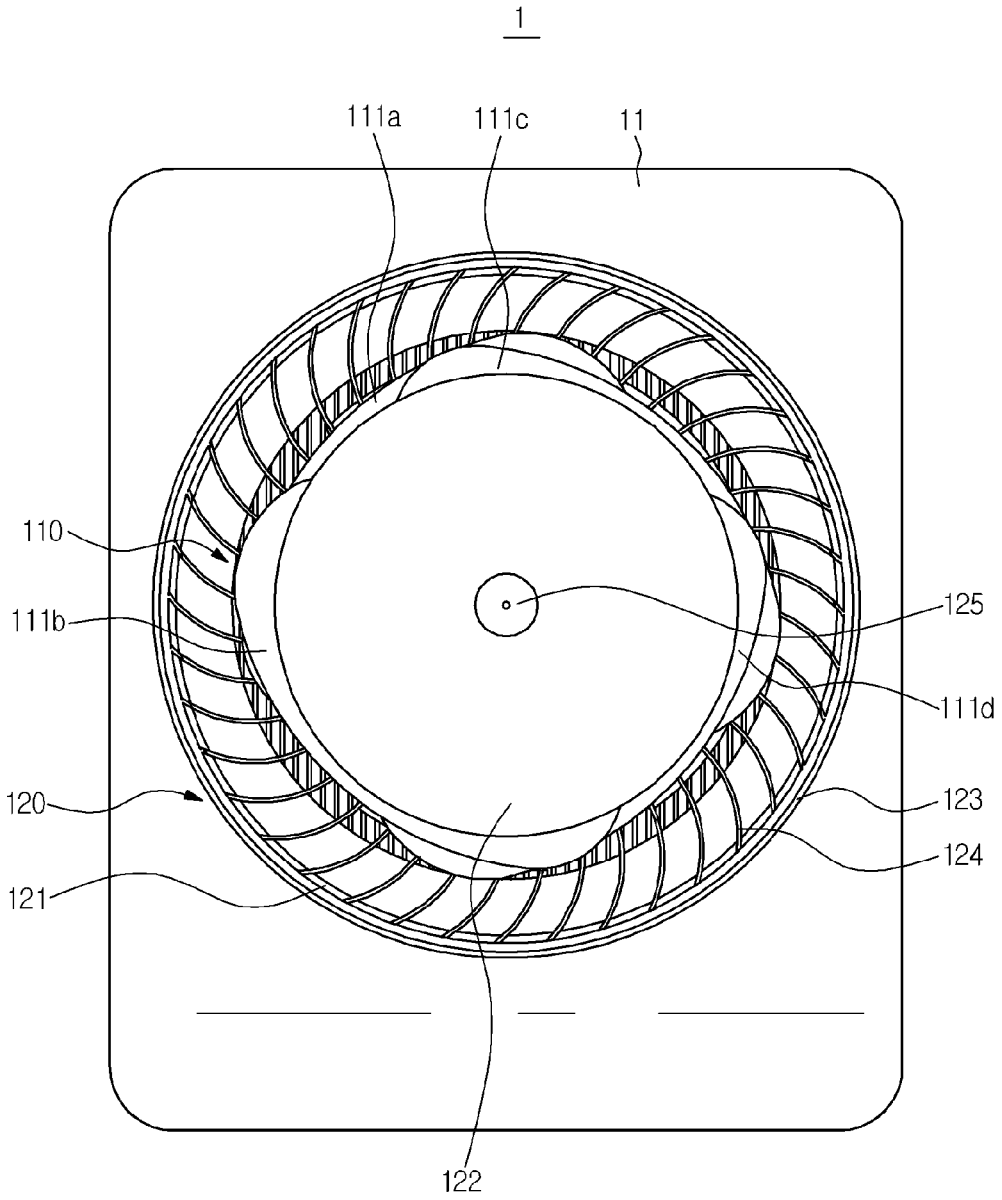
FIG. 2 is a front view illustrating the indoor unit of an air conditioner according to an embodiment of the present disclosure.
Figure 3:
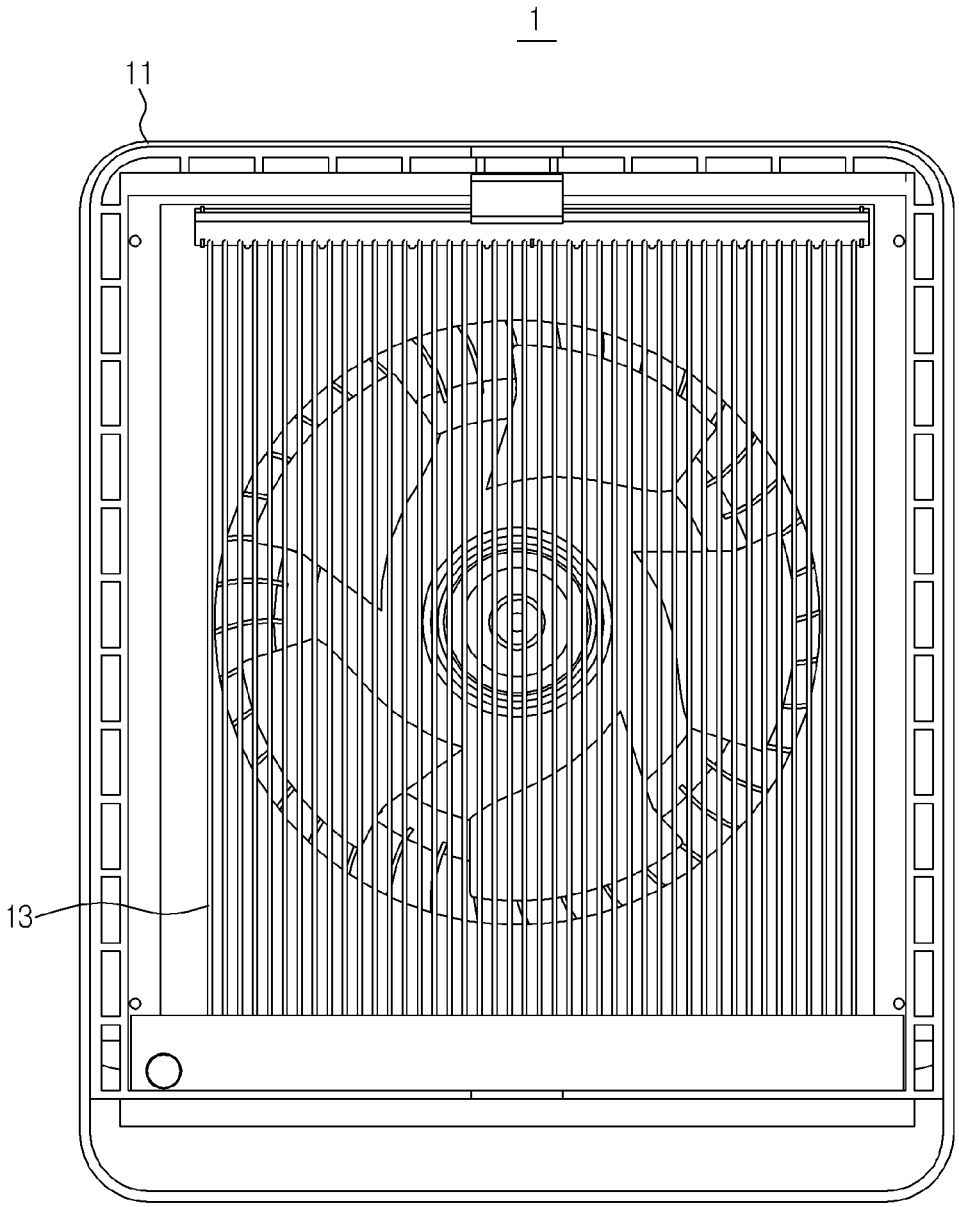
FIG. 3 is a rear view illustrating the indoor unit of an air conditioner according to an embodiment of the present disclosure.

FIG. 1 is a view illustrating an indoor unit of an air conditioner according to an embodiment of the present disclosure. FIG. 2 is a front view illustrating the indoor unit of an air conditioner according to an embodiment of the present disclosure. FIG. 3 is a rear view illustrating the indoor unit of an air conditioner according to the embodiment of the present disclosure.

As shown in FIGS. 1 to 3, an indoor unit 1 of an air conditioner according to an embodiment of the present disclosure includes a panel 10 defining an external appearance of the indoor unit 1. The panel 10 may include a front panel 11 located at the front, and a rear panel 12 coupled to the rear of the front panel 11. The panel 10 is provided therein with a mixed flow fan unit 100, and a heat exchanger unit 140 which is located rearward of the mixed flow fan unit 100. An inlet port 130 may be located rearward of the heat exchanger unit 140. Thus, the inlet port 130 may be arranged at the rear panel 12.

The front panel 11 has an opening through which an outlet port 121 to discharge air is exposed forwards. The opening may be circular.

The inlet port 130 may have a substantially rectangular shape, and be located in at least a portion of the panel 10. The inlet port 130 may be located rearward of the heat exchanger unit 140 for the smooth flow of air. The inlet port 130 may be located at a portion of the panel 10 located rearward of the heat exchanger unit 140. Thus, the inlet port 130 may be located on at least any one of an upper portion, a rear portion, and both side portions of the panel so long as the inlet port 130 is positioned rearward of the heat exchanger unit 140. The inlet port 130 is mounted therein with a filter 13 to filter minute impurities contained in air which is introduced through the inlet port 130. Although the inlet port 130 is located at the rear panel 12 for the smooth introduction and discharge of air, the inlet port 130 may be formed at a position corresponding to the outlet port 121 of the front panel 11.

The mixed flow fan unit 100 may include a diffuser 120 which forms the outlet port 121, a mixed flow fan motor 107 which is coupled to the rear of the diffuser 120, a mixed flow fan 150 which is rotatably coupled to the mixed flow fan motor 107, and a duct 160 which is coupled to the rear of the diffuser 120 to form a moving passage of air during discharge of the air introduced by the mixed flow fan 107 into the outlet port 121.

The diffuser 120 includes a circular disc plate 122, a circular grill 123 which is coupled to an outer peripheral surface of the disc plate 122, and a ring-shaped outlet port 121 which is formed between the disc plate 122 and the grill 123. The diffuser 120 is disposed forward of the mixed flow fan 150 to allow air passing through the mixed flow fan 150 to be discharged forward of the front panel 11 through the outlet port 121. When the mixed flow fan 150 having the oblique passage of air is used due to the ring-shaped outlet port 121, resistance between the mixed flow fan 150 and the front panel 11 in which the opening is positioned may be decreased. Thus, air may be smoothly discharged from the inside of the panel 10 of the indoor unit 1 of an air conditioner to the outside, thereby enhancing performance of the air conditioner.

The grill 123 includes blade plates 124, the direction and volume of air discharged through the outlet port 121 may be regulated by adjusting the number, shape, alignment angle, or the like of the blade plates 124.

Alternatively, the direction and volume of air discharged through the outlet port 121 may also be regulated by varying a radial width of the outlet port 121 by adjusting of a gap between the disc plate 122 and the grill 123. In addition, the direction and volume of air discharged through the outlet port 121 may also be regulated by adjusting a diameter of the disc plate 122. To this end, an opening and closing unit 110 may be arranged between the disc plate 122 and the grill 123. The opening and closing unit 110 may include at least one louver 111, and the ring-shaped outlet port 121 may be opened and closed depending on movement of the circular louver 111.

The mixed flow fan 150 is arranged between the diffuser 120 and the heat exchanger unit 140 to allow air exchanged with heat in the heat exchanger unit 140 to be introduced and discharged through the outlet port 121.

In addition, the indoor unit 1 may include a shaft 125 to couple the disc plate 122 with the opening and closing unit 110, and the shaft 125 may be coupled to a central axis of the disc plate 122.

Figure 4:
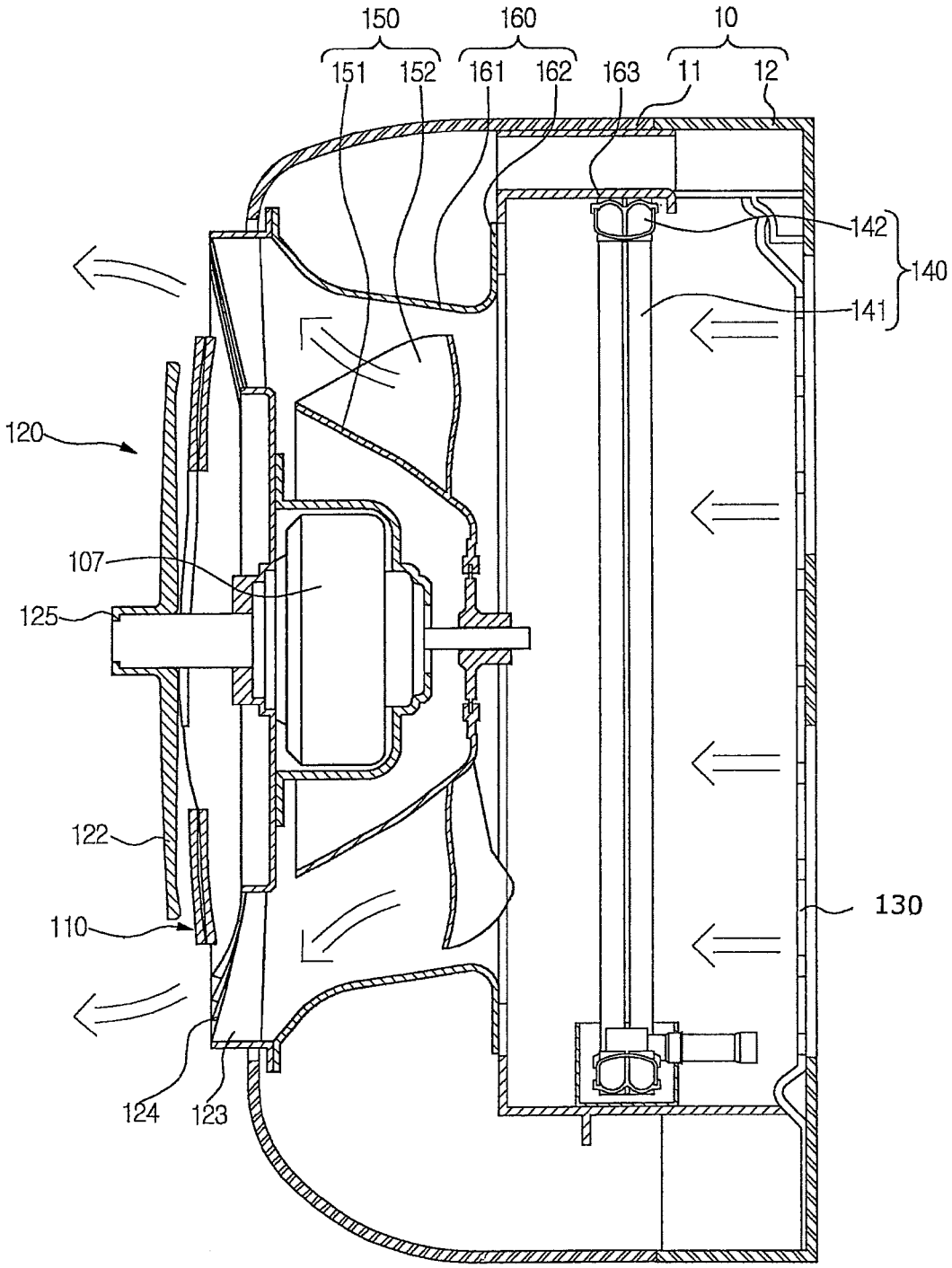
FIG. 4 is a cross-sectional view illustrating the indoor unit of an air conditioner according to an embodiment of the present disclosure.

FIG. 4 is a cross-sectional view illustrating the indoor unit of an air conditioner according to an embodiment of the present disclosure.

As shown in FIG. 4, the mixed flow fan motor 107 is coupled to a rear portion of the disc plate 122 so that a rotation shaft of the mixed flow fan motor 107 is disposed toward the rear panel 12, and rotatably drives the mixed flow fan 150.

The mixed flow fan 150 includes a hub 151 located at a central portion thereof, and a plurality of fan blades 152 coupled outside the hub 151. The hub 151 may have an inclined outer peripheral surface and a diameter which is decreased toward the inlet port 130. That is, the diameter of the hub 151 is decreased as being directed rearward of the panel 10. The outer peripheral surface of the hub 151 is inclined so that air introduced by the mixed flow fan 150 is obliquely discharged toward the outlet port 121.

The fan blades 152 coupled to the outer peripheral surface of the hub 151 may be arranged to be spaced at equal intervals along the outer peripheral surface of the hub 151. The fan blades 152 form the uniform flow of air by forming a pressure gradient in forward and rearward directions of the mixed flow fan 150 during rotation together with the hub 151.

The duct 160 includes a passage forming tube 161 which has a circular shape enclosing the mixed flow fan 150 and forms the passage of air so that air introduced by the mixed flow fan 150 may be discharged to the outlet port 121, and a fixing plate 162 which is connected rearward of the passage forming tube 161 to fix the duct 160 to the inside of the panel 10.

The passage forming tube 161 may have an inclined side surface so that air introduced by the mixed flow fan 150 together with the hub 151 may be obliquely discharged toward the outlet port 121. The passage forming tube 161 is fixedly coupled, at a front entry surface thereof, with the diffuser 120, and the duct 160 is fixedly coupled to a fixing frame 163 through the fixing plate 162 having a quadrangular shape.

The opening and closing unit 110 is coupled to the front entry surface of the passage forming tube 161 so that at least a portion of the passage forming tube 161 may be opened and closed.

The heat exchanger unit 140 is arranged between the mixed flow fan unit 100 and the inlet port 130 so as to absorb heat from air introduced through the inlet port 130 or transfer heat to the air introduced through the inlet port 130.

The heat exchanger unit 140 may include a tube 141 and headers 142 which are respectively coupled to upper and lower portions of the tube 141.

The following description will be given of the flow of air within the indoor unit 1 of an air conditioner. Air, which is introduced from the inlet port 130 located rearward of the heat exchanger unit 140, absorbs or loses heat while passing through the heat exchanger unit 140. The air, which is exchanged with heat while passing through the heat exchanger unit 140, is introduced by the mixed flow fan 150 and is then discharged through the duct 160 and the outlet port 121 to the outside.

Figure 5:
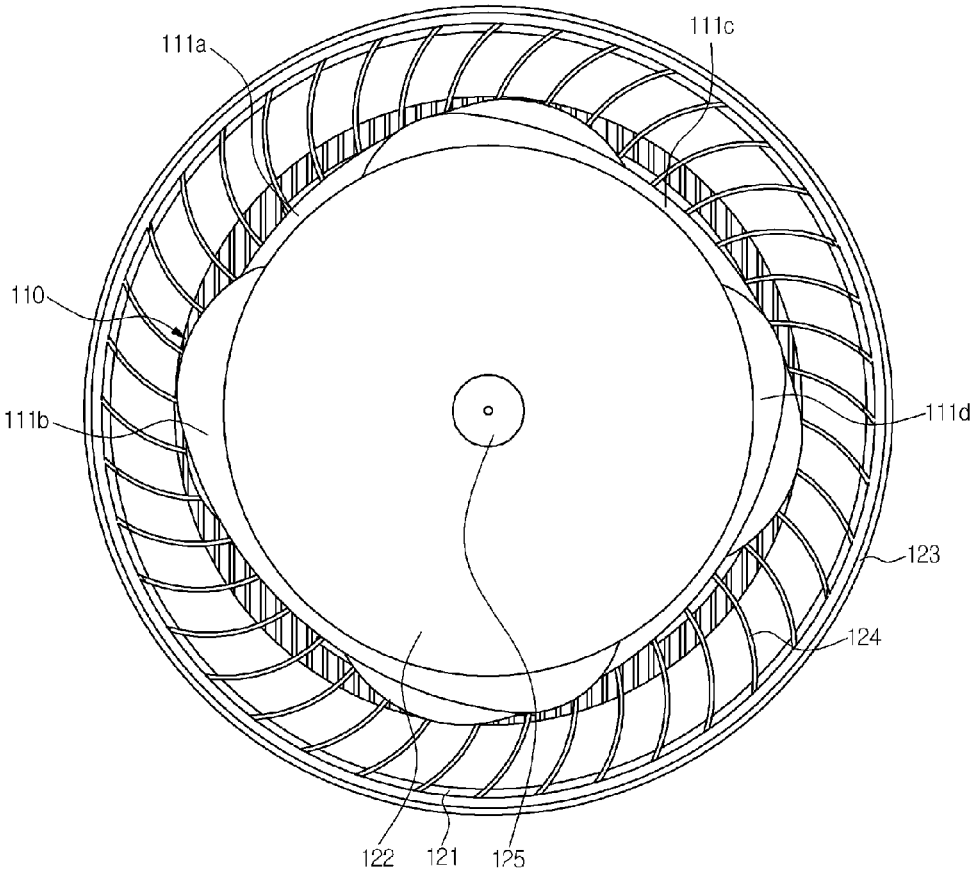
FIG. 5 is a view illustrating an opened state of an outlet port in the indoor unit of an air conditioner according to an embodiment of the present disclosure.
Figure 6:
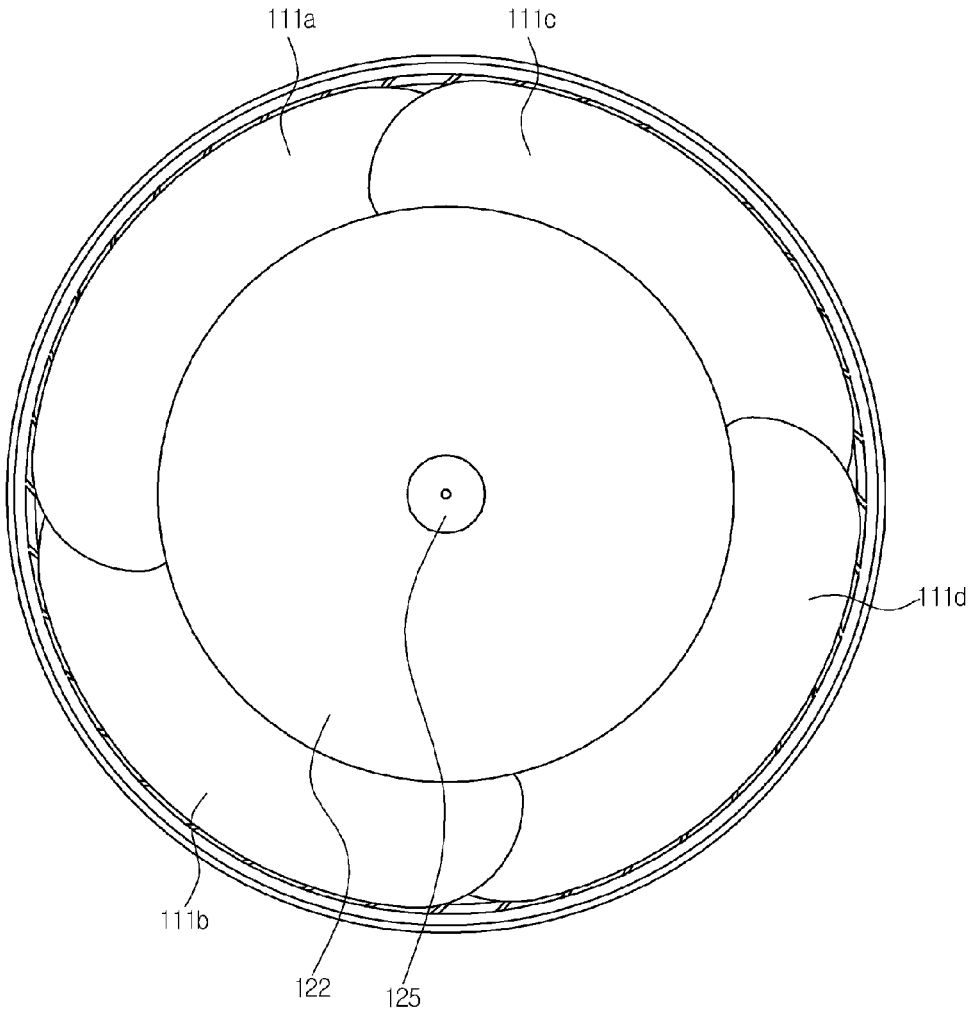
FIG. 6 is a view illustrating a closed state of the outlet port in the indoor unit of an air conditioner according to an embodiment of the present disclosure.
Figure 7:
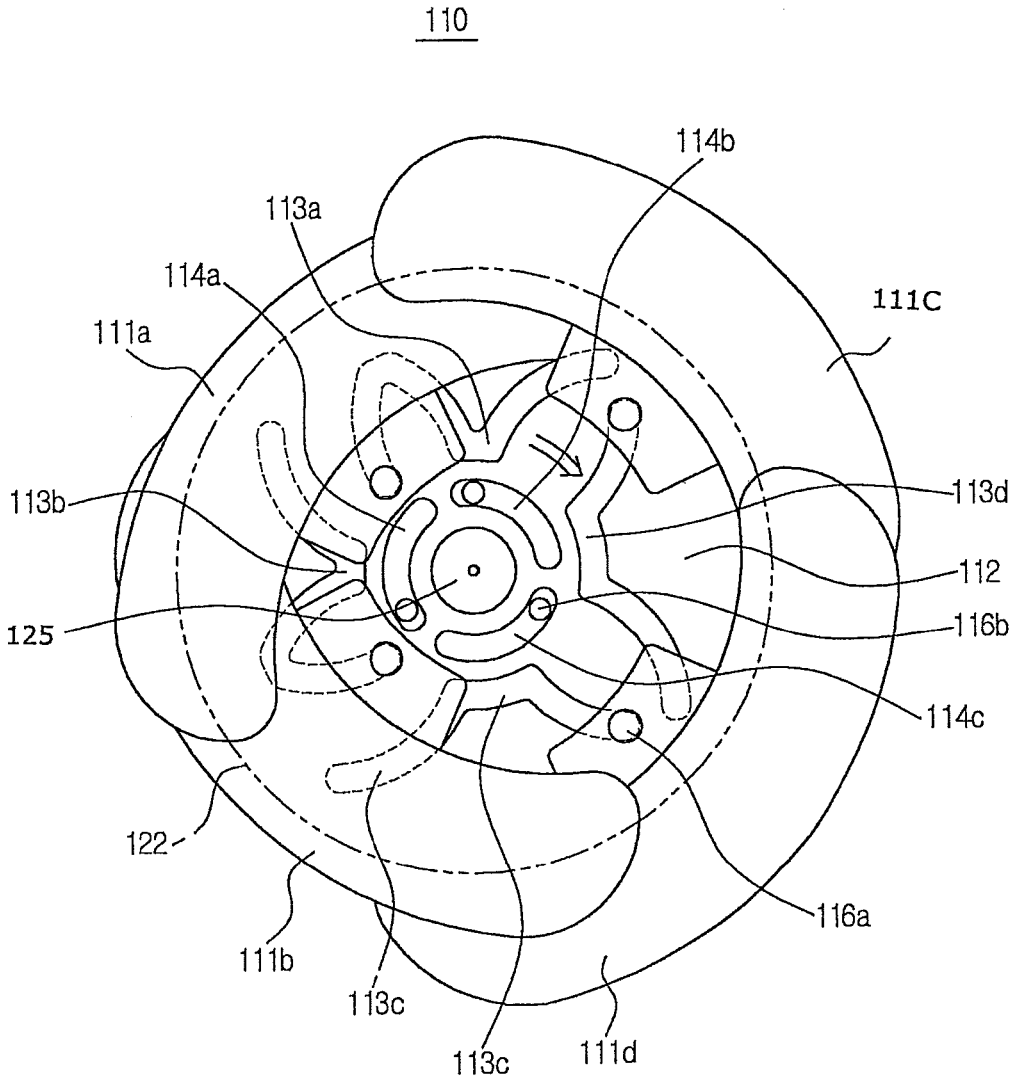
FIG. 7 is a view illustrating an opened state of the left portion of the outlet port in the indoor unit of an air conditioner according to an embodiment of the present disclosure.
Figure 8:
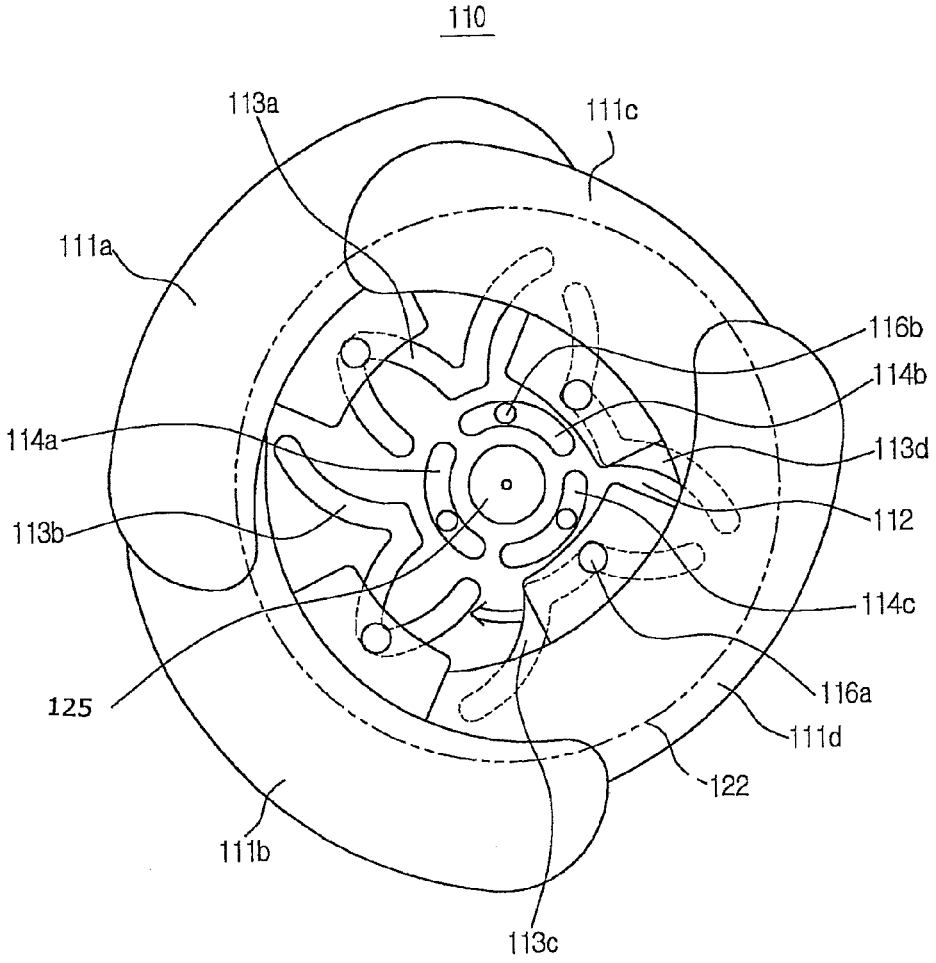
FIG. 8 is a view illustrating an opened state of the right portion of the outlet port in the indoor unit of an air conditioner according to an embodiment of the present disclosure.
Figure 9:
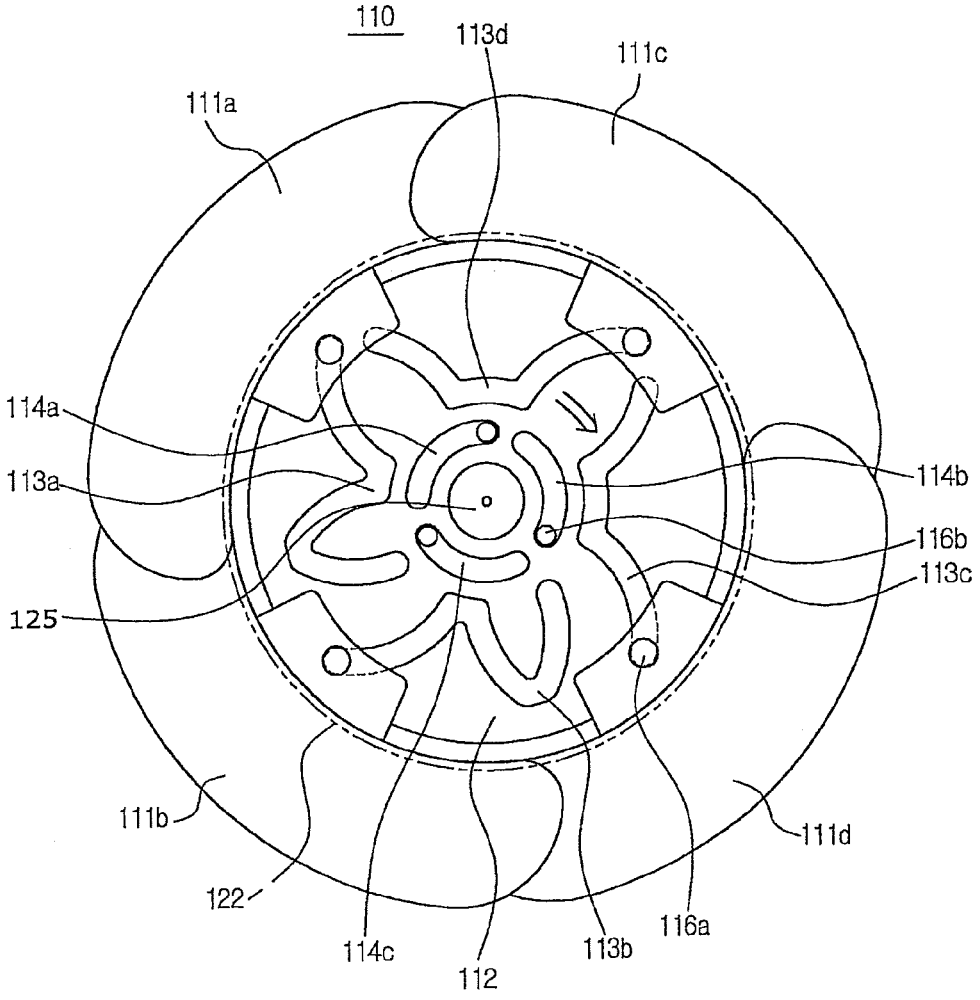
FIG. 9 is a view illustrating the inside in the closed state of the outlet port in the indoor unit of an air conditioner according to an embodiment of the present disclosure.
Figure 10:
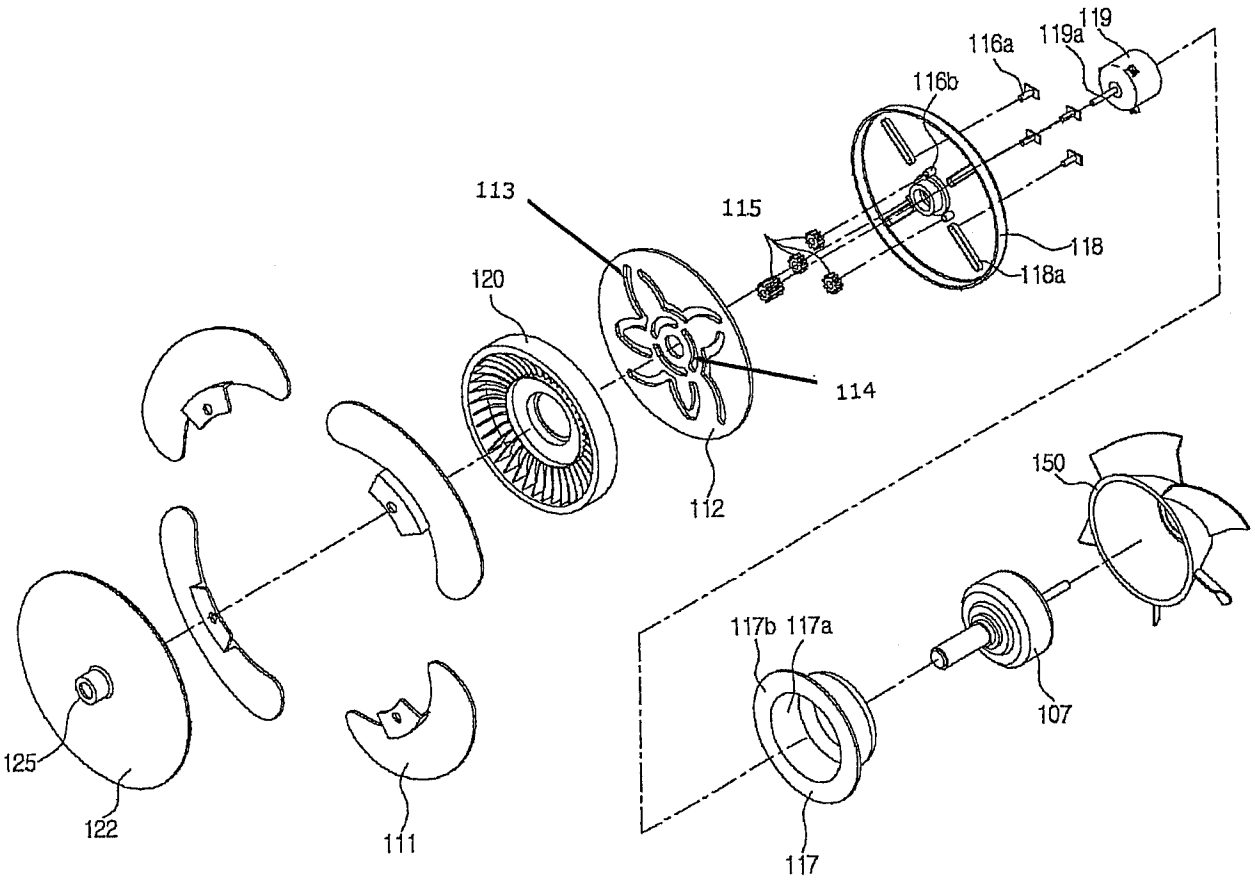
FIG. 10 is an exploded view illustrating an opening and closing unit of the indoor unit of an air conditioner according to an embodiment of the present disclosure.

FIG. 5 is a view illustrating an opened state of the outlet port in the indoor unit of an air conditioner according to an embodiment of the present disclosure. FIG. 6 is a view illustrating a closed state of the outlet port in the indoor unit of an air conditioner according to an embodiment of the present disclosure. FIG. 7 is a view illustrating an opened state of the left portion of the outlet port in the indoor unit of an air conditioner according to an embodiment of the present disclosure. FIG. 8 is a view illustrating an opened state of the right portion of the outlet port in the indoor unit of an air conditioner according to an embodiment of the present disclosure. FIG. 9 is a view illustrating the inside in the closed state of the outlet port in the indoor unit of an air conditioner according to an embodiment of the present disclosure. FIG. 10 is an exploded view illustrating the opening and closing unit of the indoor unit of an air conditioner according to an embodiment of the present disclosure.

As shown in FIGS. 5 to 10, the at least one circular louver 111 of the opening and closing unit 110 may close the outlet port 121 by moving outwards from a center of the outlet port 121, and may open the outlet port 121 by moving toward the center from outward of the outlet port 121. During opening of the outlet port 121, the at least one circular louver 111 may have design aesthetics at an external appearance thereof because being accommodated below the disc plate 122.

The opening and closing unit 110 may include at least one circular louver 111, drive discs 112 and 118 to move the circular louver 111, and a drive motor 119 to drive the drive discs 112 and 118.

Although the opening and closing unit 110 may include four circular louvers 111 in an embodiment, the present disclosure is not limited thereto. Any number of circular louvers may be provided for the opening and closing unit 110. When the four circular louvers 111 are provided, two circular louvers 111*a* and 111*b* open and close the left portion of the outlet port 121, whereas other two circular louvers 111*c* and 111*d* open and close the right portion of the outlet port 121. The circular louvers to open and close the left portion of the outlet port 121 are referred to as a first circular louver 111*a* and a second circular louver 111*b*. Also, the circular louvers to open and close the right portion of the outlet port 121 are referred to as a third circular louver 111*c* and a fourth circular louver 111*d*.

The drive discs 112 and 118 may include a fixing disc 118 which is coupled with the circular louvers 111, and a rotatable disc 112 which is coupled between the fixing disc 118 and the circular louvers 111 and rotates to move the circular louvers 111 coupled the fixing disc 118. The louver drive motor 119 to rotate the rotatable disc 112 is coupled to the rear the fixing disc 118. The louver drive motor 119 is provided with a rotation shaft 119*a* which is coupled at centers of the fixing disc 118 and the rotatable disc 112. A louver drive motor housing 117 may be coupled to the rear of the louver drive motor 119 in order to accommodate the same.

The louver drive motor housing 117 may include a seating portion 117*a* to accommodate the louver drive motor 119, and an outer portion 117*b* to be coupled with the drive discs 112 and 118.

The fixing disc 118 may be provided with fixing disc rails 118*a* which are moving routes of the circular louvers 111. The rotatable disc 112 may be provided with rotatable disc rails 113 to move the circular louvers 111 along the respective fixing disc rails 118*a*. The circular louvers 111 are coupled with the fixing disc 118 through the rotatable disc rails 113 of the rotatable disc 112. That is, coupling members 116*a* pass through the respective rotatable disc rails 113, thereby coupling the circular louvers 111 to the fixing disc 118. Each of the coupling members 116*a* may be coupled, at one side thereof, to the fixing disc 118 while being coupled, at the other side thereof, to the corresponding circular louver 111.

In addition, the fixing disc 118 may be provided with protrusions 116*b* which are fitted to the rotatable disc 112. The rotatable disc 112 may be provided with slits 114 at positions corresponding to the respective protrusions 116*b*. Thus, the protrusions 116*b* of the fixing disc 118 are coupled in the slits 114 of the rotatable disc 112, thereby preventing the rotatable disc 112 from rotating at an angle equal to or greater than a certain angle. As shown in the drawings, as a non-limiting example, three slits 114 may be provided. However, a number of slits and corresponding protrusions may be more than one, two or more than three. An imaginary circle which connects a first slit 114*a*, a second slit 114*b*, and a third slit 114*c* has a center equal to the rotatable disc 112.

The louver drive motor 119 transfers power to the rotatable disc 112 through gears 115. When the rotatable disc 112 located above the fixing disc 118 begins to rotate, the circular louvers 111, which are coupled to the fixing disc 118 through the rotatable disc rails 113 and the coupling members 116*a*, move through the fixing disc rails 118*a*. The fixing disc rails 118*a* may be arranged in, for example, a straight line in a radial direction of the fixing disc 118. Although the fixing disc 118 is in a fixed state, the coupling members 116*a* are moved through the fixing disc rails 118*a* due to rotation of the rotatable disc 112, and thus the circular louvers 111 are moved. In other words, rotary movement of the rotatable disc 112 is converted into rectilinear movement of the circular louvers 111. Therefore, the circular louvers 111 may be moved to central portions from outward of the drive discs 112 and 118, or be moved outwards from the central portions. In addition, since the four circular louvers 111 are coupled to the fixing disc 118 via the rotatable disc 112 and the fixing disc rails 118*a* are arranged so that the four circular louvers 111 are movable, the four circular louvers 111 may move along with movement of the rotatable disc 112. Consequently, even though the number of the circular louvers 111 is increased, there is no need to increase drive parts.

Meanwhile, the rotatable disc rails 113 may include first rotatable disc rails 113*a* and 113*b* and second rotatable disc rails 113*c* and 113*d* in order to individually control the left and right portions of the outlet port 121. The first rotatable disc rails 113*a* and 113*b* and the second rotatable disc rails 113*c* and 113*d* have a shape different from each other in order to individually control the left and right portions of the outlet port 121. The rotatable disc rails related to the opening and closing of the left portion of the outlet port 121 are referred to as the first rotatable disc rails 113*a* and 113*b*, whereas the rotatable disc rails related to the opening and closing of the right portion of the outlet port 121 are referred to as the second rotatable disc rails 113*c* and 113*d*.

As shown in the drawings, the first rotatable disc rails 113*a* and 113*b* and the second rotatable disc rails 113*c* and 113*d* have a shape different from each other. Therefore, when the first and second circular louvers 111*a* and 111*b*, which are driven along the first rotatable disc rails 113*a* and 113*b*, are moved toward the center of the outlet port 121, the third and fourth circular louvers 111*c* and 111*d*, which are driven along the second rotatable disc rails 113*c* and 113*d*, are movable outward of the outlet port 121, or vice versa, due to a shape difference between first rotatable disc rails 113*a* and 113*b* and the second rotatable disc rails 113*c* and 113*d*.

Figure 11:
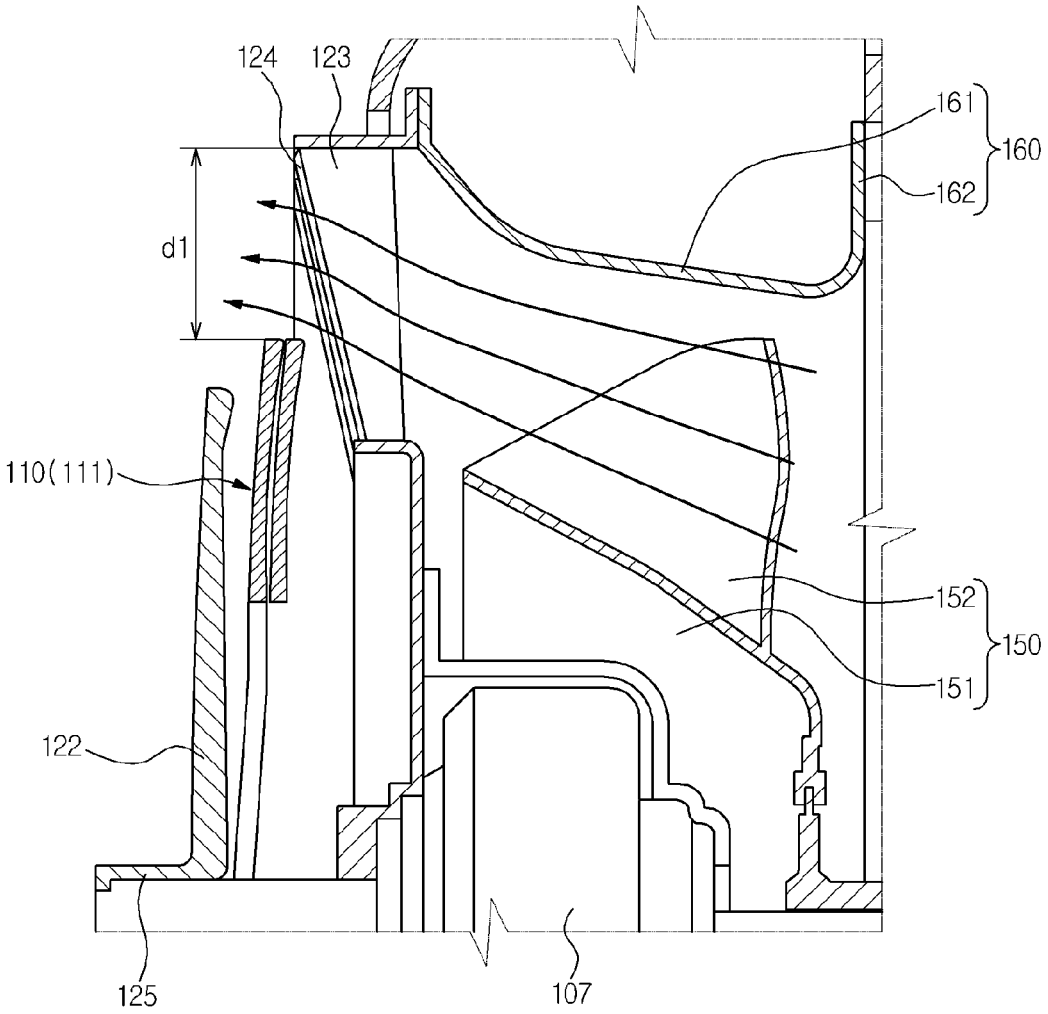
FIG. 11 is a cross-sectional view illustrating the opened state of the outlet port in the indoor unit of an air conditioner according to an embodiment of the present disclosure.
Figure 12:
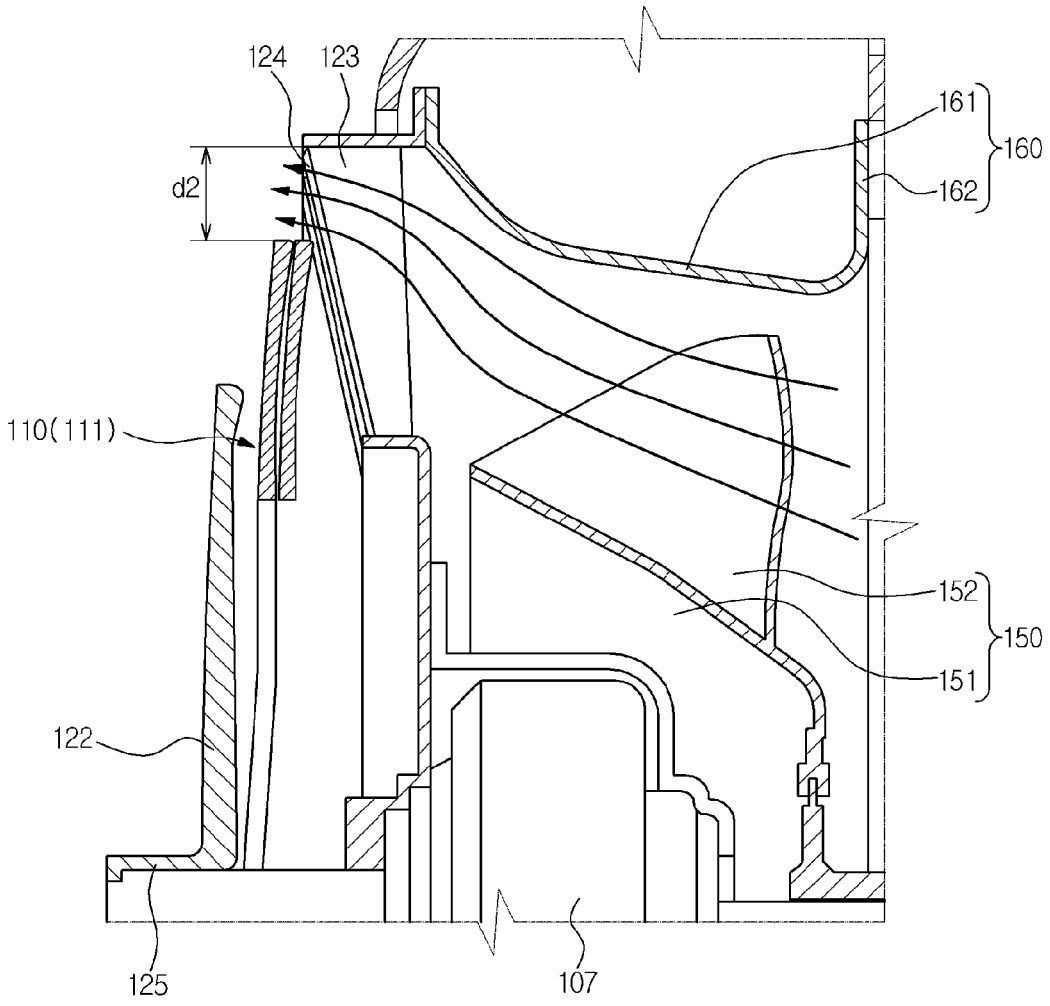
FIG. 12 is a cross-sectional view illustrating the partially closed state of the outlet port in the indoor unit of an air conditioner according to an embodiment of the present disclosure.

FIG. 11 is a cross-sectional view illustrating the opened state of the outlet port in the indoor unit of an air conditioner according to the embodiment of the present disclosure. FIG. 12 is a cross-sectional view illustrating the partially closed state of the outlet port in the indoor unit of an air conditioner according to the embodiment of the present disclosure.

As shown in FIGS. 11 and 12, each circular louver 111 of the opening and closing unit 110 may close at least a portion of the passage forming tube 161 of the duct 160. According to an embodiment of the present disclosure, the shortest distance d1 between the circular louver 111 and the duct 160 may be, for example, 40 mm in the opened state of the outlet port 121 as shown in FIG. 11. In this case, since the outlet port 121 is in the opened state, air is discharged forward of the outlet port 121.

According to an embodiment of the present disclosure, the shortest distance d2 between the circular louver 111 and the duct 160 may be, for example, 25 mm in the slightly opened state of the outlet port 121 as shown in FIG. 12. In this case, since the passage through which air is discharged is narrowed, the discharge direction of air may be adjusted to a certain extent.

Accordingly, according to an embodiment of the present disclosure, a portion of the outlet port 121 may be opened and closed by movement of the circular louver 111 of the opening and closing unit 110. Thus, only one of the left and right portions of the outlet port 121 may be opened and closed, and it may be possible to regulate the direction and volume of air by opening only a portion of the outlet port 121.

Figure 13:
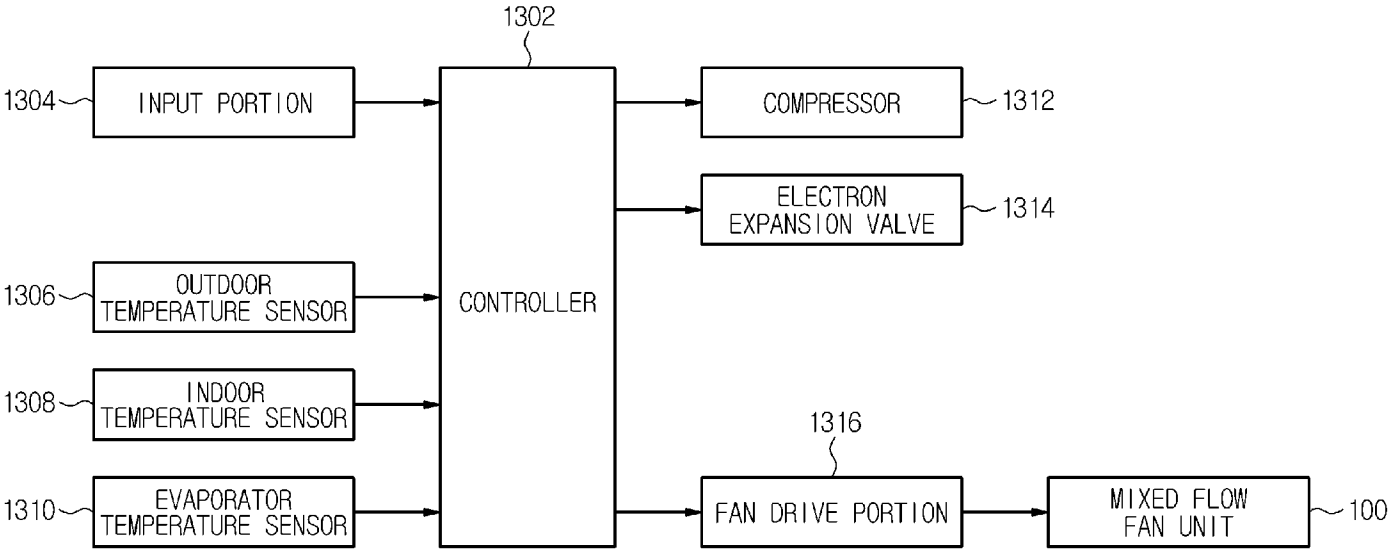
FIG. 13 is a diagram illustrating a control system of an air conditioner according to an embodiment of the present disclosure.

FIG. 13 is a diagram illustrating a control system of the air conditioner according to an embodiment of the present disclosure. As shown in FIG. 13, an input side of a controller 1302 to control a overall operation of the air conditioner is electrically connected an input portion 1304, an outdoor temperature sensor 1306, an indoor temperature sensor 1308, an evaporator temperature sensor 1310, and the like so as to communicate with each other. An output side of the controller 1302 is electrically connected with a compressor 1312, an electron expansion valve 1314, and a fan drive portion 1316 so as to communicate with each other. The fan drive portion 1316 serves to drive the mixed flow fan unit 100, and is operated according to a control command of the controller 1302 to control ON/OFF and rotation speed of the mixed flow fan unit 100 and opening/closing of the circular louver 111. The controller 1302 transmits the control command to the fan drive portion 1316 so as to control the ON/OFF and rotation speed of the mixed flow fan unit 100 and the opening/closing of the circular louver 111 depending on an operation mode selected by a user.

Figure 14:
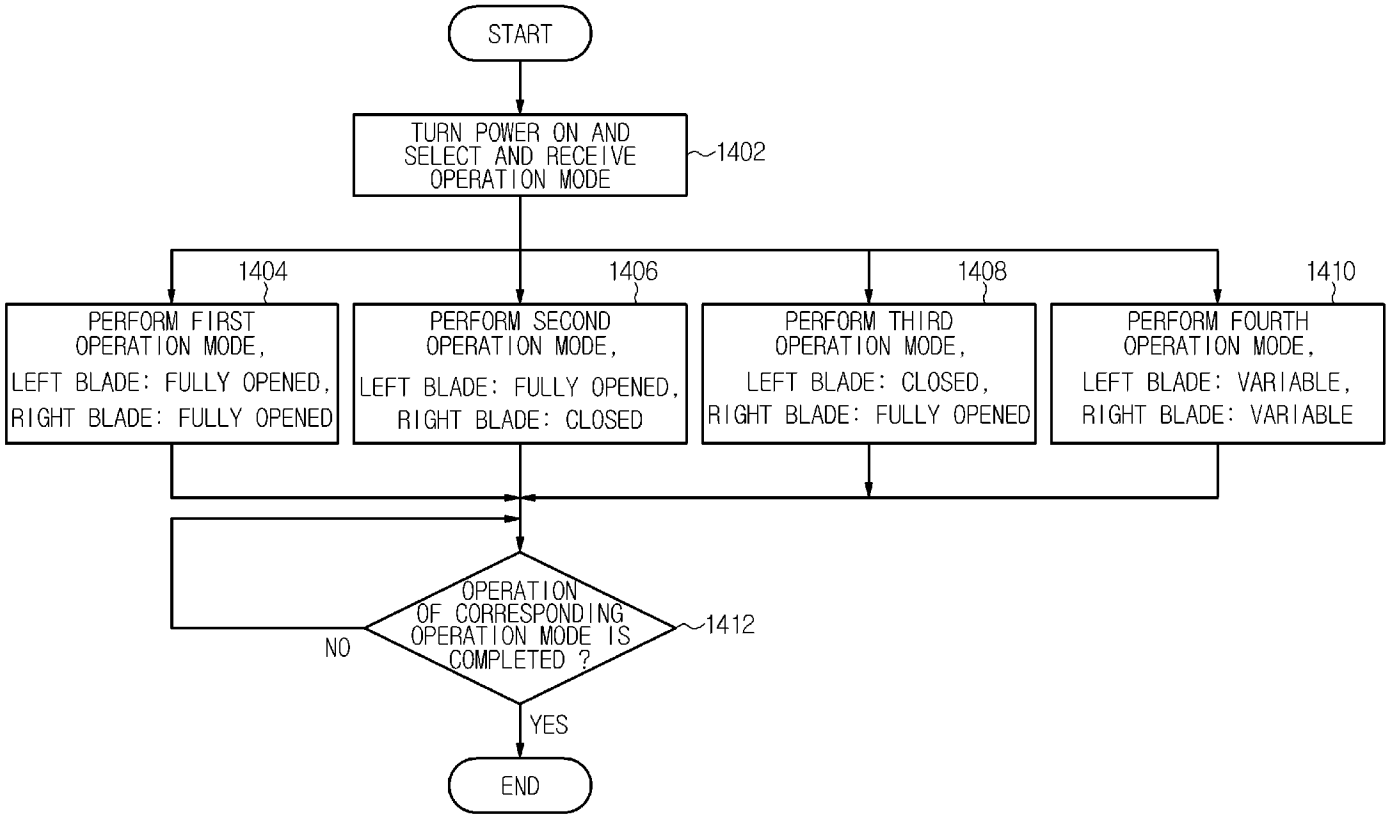
FIG. 14 is a diagram illustrating a method of controlling the air conditioner according to an embodiment of the present disclosure, based on FIG. 13.

FIG. 14 is a diagram illustrating a method of controlling the air conditioner according to an embodiment of the present disclosure, based on FIG. 13. A control method of FIG. 14 is performed by the control system shown in FIG. 13. As shown in FIG. 14, when a user turns power on to the air conditioner and selects a desired operation mode, the controller 1302 of the air conditioner receives information of the operation mode selected by a user and generates a control signal corresponding to the received operation mode to transmit the control signal to each portion of the air conditioner according to an embodiment of the present disclosure, thereby allowing an intended operation to be performed (1402). In the control method shown in FIG. 14, the controller 1302 controls the opening/closing of the circular louver 111 and the rotation speed of the mixed flow fan unit 100 depending on the selected operation mode. However, FIG. 14 illustrates only control related to the opening/closing of the circular louver 111.

When the operation mode selected by a user is a first operation mode, the controller 1302 transmits a control command to perform the first operation mode to the fan drive portion 1316, so that both of the left and right portions of the circular louver 111 of the mixed flow fan unit 100 are fully opened (1404).

When the operation mode selected by a user is a second operation mode, the controller 1302 transmits a control command to perform the second operation mode to the fan drive portion 1316, so that the left portion of the circular louver 111 of the mixed flow fan unit 100 is fully opened and the right portion thereof is closed (1406).

When the operation mode selected by a user is a third operation mode, the controller 1302 transmits a control command to perform the third operation mode to the fan drive portion 1316, so that the left portion of the circular louver 111 of the mixed flow fan unit 100 is closed and the right portion thereof is fully opened (1408).

When the operation mode selected by a user is a fourth operation mode, the controller 1302 transmits a control command to perform the fourth operation mode to the fan drive portion 1316, so that the circular louver 111 of the mixed flow fan unit 100 is variably controlled (1414). Here, the variable control of the circular louver 111 serves to open the circular louver 111 so that an opening degree of the circular louver 111 is realized at a pre-set interval such as 20 mm, 30 mm, or 40 mm. The opening degree of the circular louver 111 may be variously set, and it may be possible to independently control the opening degree of the circular louver 111 during opening of the same, in addition to the opening/closing of the left and right portions of the circular louver 111.

When the operation of the selected operation mode is performed and completed, the operation of the air conditioner is completed (1412). In this case, the operation of the air conditioner may be completed in a state in which the circular louver 111 of the mixed flow fan unit 100 is opened or closed.

Figure 15:
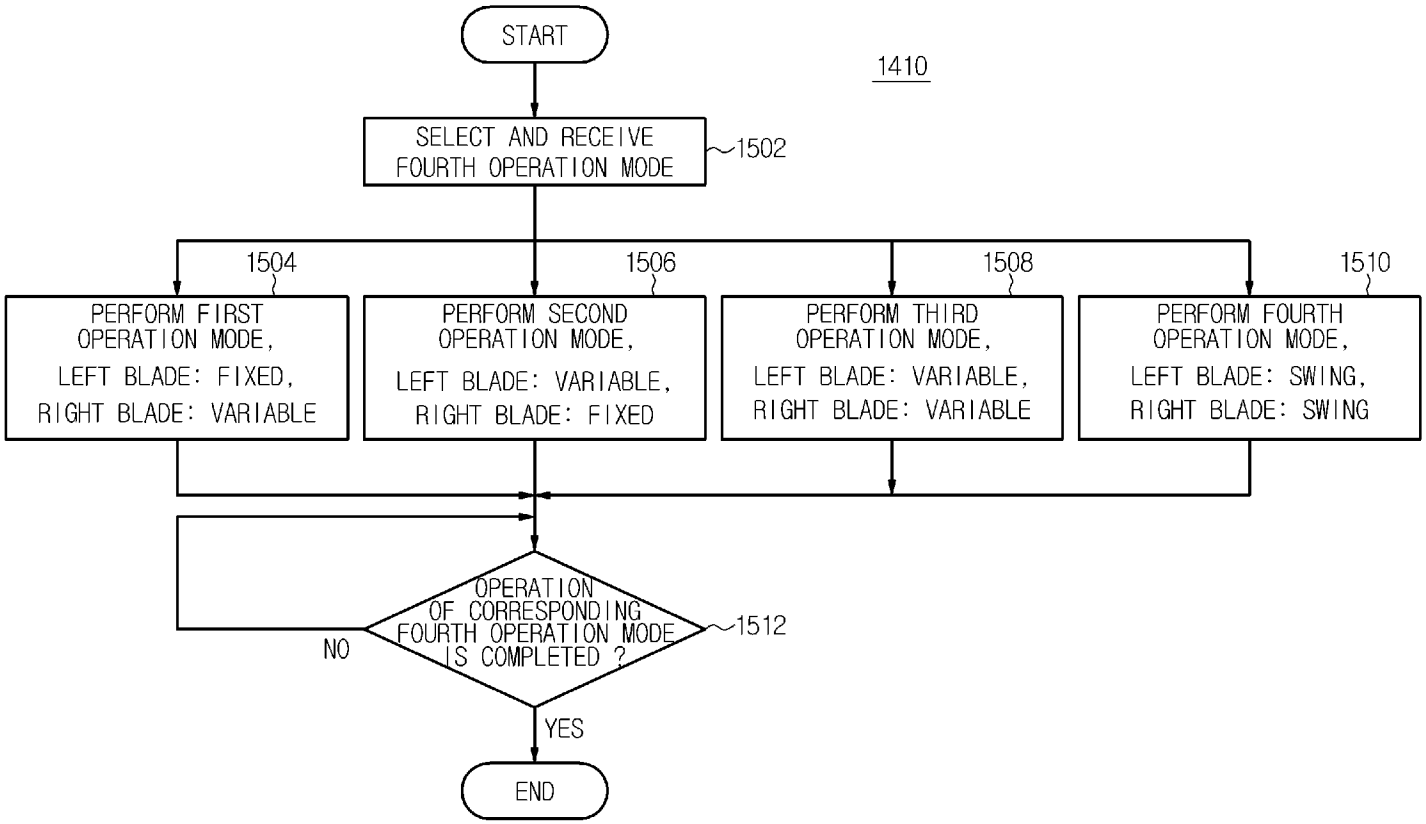
FIG. 15 is a diagram illustrating a control method of a fourth operational mode shown in FIG. 14.

FIG. 15 is a diagram illustrating the control method of the fourth operational mode shown in FIG. 14. The control method of FIG. 15 is performed by the control system shown in FIG. 13. As shown in FIG. 15, when a user selects the fourth operational mode, the controller 1302 of the air conditioner generates a control signal corresponding to the fourth operation mode selected by a user to transmit the control signal to the fan drive portion 1316. The fourth operation mode according to an embodiment of the present disclosure serves to variably control the opening degree of the circular louver 111 of the mixed flow fan unit 100. As shown in FIG. 15, in the fourth operation mode, it may be possible to independently control the opening degree of the circular louver 111 during opening of the same, in addition to the opening/closing of the left and right portions of the circular louver 111. The independently controlling of the circular louver 111 may be determined based on positions of humans in an air conditioning space, distribution of room temperature, setting required by a user, and the like.

When a first variable mode is performed in the fourth operation mode, the controller 1302 transmits a control command to perform the first variable mode to the fan drive portion 1316, so that the left portion of the circular louver 111 of the mixed flow fan unit 100 is fixed, for example, opened or closed, and only the right portion thereof is variably controlled (1504).

When a second variable mode is performed in the fourth operation mode, the controller 1302 transmits a control command to perform the second variable mode to the fan drive portion 1316, so that the left portion of the circular louver 111 of the mixed flow fan unit 100 is variably controlled and the right portion thereof is fixed (1506).

When a third variable mode is performed in the fourth operation mode, the controller 1302 transmits a control command to perform the third variable mode to the fan drive portion 1316, so that both of the left and right portions of the circular louver 111 of the mixed flow fan unit 100 are variably controlled (1508).

When a fourth variable mode is performed in the fourth operation mode, the controller 1302 transmits a control command to perform the fourth variable mode to the fan drive portion 1316, so that both of the left and right portions of the circular louver 111 of the mixed flow fan unit 100 may be swung (1510). Here, the swing of the circular louver 111 refers to periodic repetition of the opening and closing of the circular louver 111. In this case, the opening degree and opening period of the circular louver 111 may be determined based on positions of humans in an air conditioning space, distribution of room temperature, setting required by a user, and the like.

When the operation of the selected operation mode is performed and completed, the operation of the air conditioner is completed (1512). In this case, the operation of the air conditioner may be completed in a state in which the circular louver 111 of the mixed flow fan unit 100 is opened or closed.

As is apparent from the above description, an indoor unit of an air conditioner according to the present disclosure has a simplified structure of an air passage, thereby enabling operation efficiency to be enhanced and a compact size to be achieved.

In addition, the left and right portions of an outlet port may be separately opened and closed, and the indoor unit also has design aesthetics by an opening and closing unit located at a lower side of a disc.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An indoor unit of an air conditioner, comprising:

a panel which defines an external appearance thereof and has an opening;

a mixed flow fan which is located within the panel;

a heat exchanger unit which is located rearward of the mixed flow fan;

an inlet port which is located rearward of the heat exchanger unit so that air is suctioned from rearward of the heat exchanger unit to be introduced into the mixed flow fan;

an outlet port which is exposed forward of the panel through the opening so that the air passing though the mixed flow fan is discharged through a front portion of the panel;

a louver unit to close the outlet port by moving outwards from a center portion of the outlet port and to open the outlet port by moving toward the center portion of the outlet port when the outlet port is closed by the louver unit, the louver unit including a plurality of louvers and to form substantially a circular shape corresponding to the outlet port when the louver unit closes the outlet port; and a drive disc which is coupled to the louvers to move the louvers, the drive disc including a fixing disc to which the louvers are coupled and including the fixing disc rail, and a rotatable disc which is coupled between the fixing disc and the louvers and to rotate to move the louvers coupled to the fixing disc, and including a rotatable disc rail, wherein the drive disc moves the louvers along a route formed by the fixing disc rail and the rotatable disc rail to open or close the outlet port.

2. The indoor unit of an air conditioner according to claim 1, wherein the plurality of louvers are coupled to a drive disc to move the louvers, and the drive disc is coupled to a louver drive motor so as to be driven.

3. The indoor unit of an air conditioner according to claim 2, wherein the drive disc comprises a fixing disc to which the louvers are coupled, and a rotatable disc which is coupled between the fixing disc and the louvers and rotates to move the louvers coupled to the fixing disc.

4. The indoor unit of an air conditioner according to claim 3, wherein the fixing disc is provided with a fixing disc rail which is a moving route of each of the louvers, and the rotatable disc is provided with a rotatable disc rail to move the louver along the fixing disc rail.

5. The indoor unit of an air conditioner according to claim 3, further comprising:

a coupling member to couple each of the louvers to the fixing disc.

6. The indoor unit of an air conditioner according to claim 4, wherein the rotatable disc rail comprises a first rotatable disc rail and a second rotatable disc rail which have different shapes to individually open and close the left and right portions of the outlet port.

7. The indoor unit of an air conditioner according to claim 2, further comprising a louver drive motor housing to accommodate the louver drive motor.

8. An indoor unit of an air conditioner, comprising:

a panel which defines an external appearance thereof and has an opening;

a mixed flow fan which is located within the panel;

a heat exchanger unit which is located rearward of the mixed flow fan;

an inlet port which is located rearward of the heat exchanger unit so that air is suctioned from rearward of the heat exchanger unit to be introduced into the mixed flow fan;

an outlet port which is exposed forward of the panel through the opening so that the air passing though the mixed flow fan is discharged through a front portion of the panel;

a louver unit to close the outlet port by moving outwards from a center portion of the outlet port and to open the outlet port by moving toward the center portion of the outlet port when the outlet port is closed by the louver unit, the louver unit including a plurality of louvers and to form substantially a circular shape corresponding to the outlet port when the louver unit closes the outlet port and a diffuser which is arranged forward of the mixed flow fan, wherein the diffuser comprises a circular disc plate and a grill which is coupled to an outer peripheral surface of the disc plate, and the outlet port is formed between the disc plate and the grill.

9. The indoor unit of an air conditioner according to claim 8, wherein the louvers are located between the disc plate and the grill to open and close the outlet port.

10. The indoor unit of an air conditioner according to claim 1, further comprising a controller which independently controls each of the plurality of louvers according to a selected operation mode and generates a control command to open and close all or a portion of the outlet port.

11. An indoor unit of an air conditioner, comprising:

a panel which comprises a front panel having an opening, a rear panel coupled to the front panel;

an inlet port which is formed in the rear panel;

an outlet port which is formed at a position corresponding to the inlet port;

a heat exchanger which is arranged forward of the inlet port;

a mixed flow fan unit which is arranged forward of the heat exchanger and has the outlet port exposed forward of the front panel through the opening; and an opening and closing unit to open and close at least a portion of the outlet port, wherein the opening and closing unit comprises:

a louver unit to close the outlet port by moving outwards from a central portion of the outlet port, and to open the outlet port by moving toward the central portion of the outlet port when the outlet port is closed by the louver unit, the louver unit including a plurality of louvers and to form substantially a circular shape corresponding to the outlet port when the louver unit closes the outlet port;

a drive disc to move the louvers, the drive disc including a fixing disc to which the louvers are coupled and including the fixing disc rail, and a rotatable disc which is coupled between the fixing disc and the louvers and to rotate to move the louvers coupled to the fixing disc, and including a rotatable disc rail, wherein the drive disc moves the louvers along a route formed by the fixing disc rail and the rotatable disc rail to open or close the outlet port; and a louver drive motor which drives the drive disc to drive the louvers.

12. The indoor unit of an air conditioner according to claim 11, wherein the drive disc comprises a fixing disc to which the louvers are coupled, and a rotatable disc which is coupled between the fixing disc and the louvers and rotates such that the louvers coupled to the fixing disc are linearly moved outwards from the central portion of the outlet port.

13. The indoor unit of an air conditioner according to claim 12, wherein the fixing disc is provided with a fixing disc rail which is a moving route of each of the louvers, and the rotatable disc is provided with a rotatable disc rail to move the louver along the fixing disc rail.

14. The indoor unit of an air conditioner according to claim 13, wherein:

the louvers comprise a first louver and a second louver which open and close the left portion of the outlet port and a third louver and a fourth louver which open and close the right portion of the outlet port;

the rotatable disc rail comprises first rotatable disc rails which are respectively coupled with the first and second louvers, and second rotatable disc rails which are respectively coupled with the third and fourth louvers; and the first and second rotatable disc rails have different shapes.

15. The indoor unit of an air conditioner according to claim 11, further comprising a controller which independently controls each of the plurality of louvers according to a selected operation mode and generates a control command to open and close all or a portion of the outlet port.

16. The indoor unit of an air conditioner according to claim 3, wherein the fixing disc is provided with protrusions and the rotatable disc is provided with slits at positions corresponding to the respective protrusions such that the protrusions of the fixing disc are coupled in the slits of the rotatable disc to rotate the rotatable disc up to a predetermined angle.

* * * * *